US009088852B2

(12) United States Patent
Shennib et al.

(10) Patent No.: US 9,088,852 B2
(45) Date of Patent: Jul. 21, 2015

(54) DISENGAGEMENT TOOL FOR A MODULAR CANAL HEARING DEVICE AND SYSTEMS INCLUDING SAME

(71) Applicant: iHEAR MEDICAL, INC., San Leandro, CA (US)

(72) Inventors: Adnan Shennib, Oakland, CA (US); Victor Valenzuela, Hayward, CA (US)

(73) Assignee: iHear Medical, Inc., San Leandro, CA (US)

( * ) Notice: Subject to any disclaimer, the term of this patent is extended or adjusted under 35 U.S.C. 154(b) by 86 days.

(21) Appl. No.: 13/787,653

(22) Filed: Mar. 6, 2013

(65) Prior Publication Data

US 2014/0254843 A1 Sep. 11, 2014

(51) Int. Cl.
*H04R 25/00* (2006.01)

(52) U.S. Cl.
CPC ..... *H04R 25/608* (2013.01); *H04R 25/65* (2013.01)

(58) Field of Classification Search
USPC ..... 381/314, 328, 329, 322, 323
See application file for complete search history.

(56) References Cited

U.S. PATENT DOCUMENTS

| | | | | |
|---|---|---|---|---|
| 5,327,500 | A | 7/1994 | Campbell | |
| 5,553,152 | A | 9/1996 | Newton | |
| 5,645,074 | A | 7/1997 | Shennib et al. | |
| 5,659,621 | A | 8/1997 | Newton | |
| 5,701,348 | A * | 12/1997 | Shennib et al. | 381/328 |
| 5,785,661 | A | 7/1998 | Shennib et al. | |
| 6,137,889 | A | 10/2000 | Shennib et al. | |
| 6,212,283 | B1 | 4/2001 | Fletcher et al. | |
| 6,359,993 | B2 | 3/2002 | Brimhall | |
| 6,367,578 | B1 | 4/2002 | Shoemaker | |
| 6,473,513 | B1 | 10/2002 | Shennib et al. | |
| 6,546,108 | B1 * | 4/2003 | Shennib et al. | 381/322 |
| 6,724,902 | B1 | 4/2004 | Shennib et al. | |
| 6,937,735 | B2 | 8/2005 | DeRoo et al. | |
| 6,940,988 | B1 | 9/2005 | Shennib et al. | |
| 7,010,137 | B1 * | 3/2006 | Leedom et al. | 381/328 |
| 7,016,511 | B1 | 3/2006 | Shennib | |
| 7,113,611 | B2 | 9/2006 | Leedom et al. | |

(Continued)

FOREIGN PATENT DOCUMENTS

WO 99/07182 A2 2/1999

OTHER PUBLICATIONS

International Search Report and Written Opinion dated Nov. 3, 2010 for PCT Appl. No. US2010/048299.

(Continued)

*Primary Examiner* — Davetta W Goins
*Assistant Examiner* — Amir Etesam
(74) *Attorney, Agent, or Firm* — Dorsey & Whitney LLP

(57) ABSTRACT

Examples of modular hearing devices and tools for disengaging a battery module from a main module of the canal hearing device are described. The disengagement tool may be used to switch the modular hearing device to the power OFF condition, or to completely remove the battery module therefrom. According to examples described, the disengagement tool comprises a receptacle cavity shaped to accommodate the lateral end of the modular hearing device, the cavity including features arranged to actuate a handle of the battery module for automatically disengaging the battery module upon insertion of the canal hearing device into the receptacle cavity. Other examples describe features for holding the battery module with the main module in either the ON or OFF positions.

30 Claims, 8 Drawing Sheets

(56) References Cited

U.S. PATENT DOCUMENTS

| | | | |
|---|---|---|---|
| 7,215,789 | B2 | 5/2007 | Shennib et al. |
| 7,260,232 | B2 | 8/2007 | Shennib |
| 7,298,857 | B2 | 11/2007 | Shennib et al. |
| 7,310,426 | B2 | 12/2007 | Shennib et al. |
| 7,321,663 | B2 | 1/2008 | Olsen |
| 7,403,629 | B1 | 7/2008 | Aceti et al. |
| 7,424,123 | B2 | 9/2008 | Shennib et al. |
| 7,424,124 | B2 | 9/2008 | Shennib et al. |
| 7,580,537 | B2 | 8/2009 | Urso et al. |
| 7,664,282 | B2 | 2/2010 | Urso et al. |
| 8,155,361 | B2 | 4/2012 | Schindler |
| 8,184,842 | B2 | 5/2012 | Howard et al. |
| 8,467,556 | B2 | 6/2013 | Shennib et al. |
| 2001/0008560 | A1 | 7/2001 | Stonikas et al. |
| 2002/0027996 | A1 | 3/2002 | Leedom et al. |
| 2002/0085728 | A1 | 7/2002 | Shennib et al. |
| 2005/0259840 | A1 | 11/2005 | Gable et al. |
| 2005/0283263 | A1 | 12/2005 | Eaton et al. |
| 2006/0291683 | A1 | 12/2006 | Urso et al. |
| 2010/0040250 | A1 | 2/2010 | Gerbert |
| 2010/0119094 | A1 | 5/2010 | Sjursen et al. |
| 2010/0239112 | A1 | 9/2010 | Howard et al. |
| 2011/0058697 | A1* | 3/2011 | Shennib et al. ..... 381/314 |
| 2013/0243229 | A1 | 9/2013 | Shennib et al. |
| 2014/0254844 | A1 | 9/2014 | Shennib |

OTHER PUBLICATIONS

"Lyric User Guide," http://www.phonak.com/content/dam/phonak/b2b/C_M_tools/Hearing_Instruments/Lyric/documents/02-gb/Userguide_Lyric_V8_GB_FINAL_WEB.pdf, Jul. 2010, pp. 1-36, Phonak AG.

"Operations Manual—2011," AMP Personal Audio Amplifiers, 2011, pp. 1-20.

* cited by examiner

DISENGAGEMENT TOOL FOR A MODULAR CANAL HEARING DEVICE AND SYSTEMS INCLUDING SAME

TECHNICAL FIELD

Examples described herein relate to hearing devices, and include particularly hearing devices that are positioned in the ear canal for inconspicuous wear. This application is related to pending patent application Ser. No. 12/878,926, titled CANAL HEARING DEVICE WITH DISPOSABLE BATTERY MODULE, filed Sep. 9, 2010, Ser. No. 13/424,242, titled BATTERY MODULE FOR PERPENDICULAR DOCKING INTO A CANAL HEARING DEVICE, filed Mar. 19, 2012, and concurrently filed patent application titled RECHARGEABLE CANAL HEARING DEVICES AND SYSTEMS, filed Mar. 6, 2013, all three of which applications are incorporated herein by reference in their entirety for any purpose.

BACKGROUND

The ear canal is generally narrow and tortuous with dimensions, and may vary significantly among individuals. Placement of a miniature hearing device inside the ear canal is generally desirable for various electroacoustic advantages, such as reduction of the acoustic occlusion effect, improved energy efficiency, reduced distortion, reduced receiver vibrations, and improved high frequency response. Canal placement may also be desirable for cosmetic reasons since many of the hearing impaired may prefer to wear an inconspicuous hearing device. A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely In the Canal (CIC), In-The-Canal (ITC), and extended wear deep canal invisible types. A canal hearing device is generally elongate with a longitudinal axis, having a medial end (facing the eardrum) and lateral end for access and manipulation.

Conventional batteries for canal hearing devices include zinc-air varieties, which are generally non-rechargeable, thus replaced frequently by the user. Given the advanced age of the average hearing aid user and diminutive size of canal hearing devices and their batteries, replacing the battery and/or manually switching off the canal hearing device are often inconvenient and frustrating tasks for the user due to the user's decreased dexterity and possible vision impairment. The present invention describes examples of modular hearing aid designs, tools, and methods which may address some of these shortcomings.

SUMMARY

The present disclosure describes examples of systems including modular canal hearing devices and tools configured to manipulate and disengage a battery module of the modular canal hearing device. Tools according to this disclosure may be used to automatically disengage the battery module upon insertion of the modular canal hearing device assembly partially into a receptacle cavity of the tool. In preferred embodiments, a lateral end of the modular canal hearing device assembly is placed into the receptacle cavity which incorporates a disengagement mechanism therein. The receptacle cavity may be configured to partially disengage the battery module from the main module, for example to switch the modular canal hearing device assembly to the OFF position, or to substantially disengage the battery module from the main module to facilitate the removal of the battery module from the canal hearing device.

In one embodiment, the main module and a battery module combine to form a modular canal hearing device. The lateral end of the modular canal hearing device may include a handle, incorporated with either the battery module or the main module. The main module may include a microphone, a receiver, and electronic circuitry. The battery module includes a battery cell which is incorporated at least partially within a housing of the battery module, in which the battery cell may be a primary or a rechargeable type. In preferred embodiments, the disengagement is performed by applying an axial force along the longitudinal axis of the modular canal hearing device during insertion of the lateral end of the modular canal hearing device into the receptacle cavity, resulting in displacement of the battery module, in a direction generally perpendicular with respect to the longitudinal axis.

A tool according to the present disclosure may include one or multiple receptacle cavities configured for disengaging the battery module. In some embodiments, the receptacle cavity includes a channel for receiving a handle of the canal hearing device and a ledge (also referred to herein as disengagement ledge) configured to actuate the handle for disengagement of the battery module. In one embodiment, when the battery module is partially disengaged from the main module, the modular canal hearing device is provided in the power OFF condition. The ledge may be sized and/or shaped to provide a desired degree of separation between the battery module and main module. For example, the profile of the disengagement ledge may be configured, in some cases, to substantially disengage the battery module from the main module to facilitate complete removal of the battery module. In the context of the present disclosure, to disengage or partially disengage the battery module implies that the battery module remains at least partially attached to the main module. A substantial disengagement of the battery module implies a separation of the battery module greater than the separation required to place the canal hearing device in the OFF position. Substantial disengagement may be achieved, for example, by actuating the handle sufficiently to cause certain holding features as will be further described to be released thereby facilitating removal of the battery module from the main module. A complete separation or removal of the battery module may be referred to herein as fully or completely disengaging the battery module.

A multifunction tool according to further examples herein includes multiple disengagement cavities, while offering additional tools for use with the modular canal hearing device assembly. The multifunction tool may include any of a power OFF receptacle cavity, a battery module removal cavity, a remote control for controlling the modular canal hearing device assembly remotely, an insertion tool for inserting the modular canal hearing device assembly into the ear canal, and a removal tool for removing the modular canal hearing device assembly from the ear canal.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

As described above, replacing a battery and or manually switching off a canal hearing device may be a difficult and/or frustrating task for a user, who may be visually impaired or have diminished dexterity. One solution would be to use a rechargeable power source, however while rechargeable hearing aids may mitigate the need to replace the battery frequently they do not address difficulties in manually switching off the hearing aid device. Using a wireless remote control to switch OFF the hearing aid device may mitigate dexterity issues. However, a wireless remote control may not be an optimal solution in all cases.

Electromechanical disengagement of the battery module may be advantageous for numerous reasons. For example, such electromechanical disengagement may reduce dependency on a remote control, which may become lost or damaged. Electromechanical disengagement may be needed for replacing the battery when damaged or depleted. Electromechanical disengagement may obviate the need for purely electronic switching which may add cost, complexity, and/or unnecessary current drain when the device is in the OFF or standby condition. Electromechanical disengagement may also be desirable for switching off the hearing device during the charging cycle of a rechargeable battery cell which may be incorporated within the canal hearing device.

The present disclosure describes examples of modular canal hearing devices, tools and methods adapted for electromechanically disengaging a battery module of modular canal hearing devices for any purpose, for example to power off the device, to charge the battery, and/or to remove the battery module. Electromechanically disengaging a battery module may be achieved conveniently with minimal effort and dexterity requirements according to the examples herein.

Figure 1:
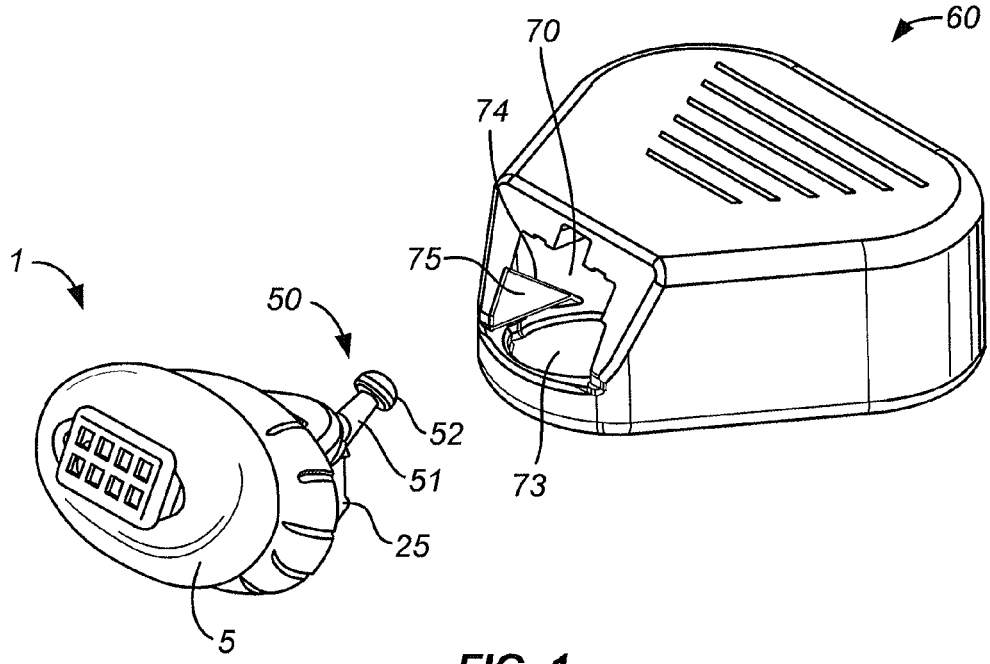
FIG. 1 is an isometric view of a system according to one example herein, which includes a modular canal hearing device and a disengagement tool with a receptacle cavity.

Examples of modular canal hearing devices and tools for manipulating and/or disengaging a battery module are shown in FIGS. 1-13 to illustrate and facilitate an understanding of the present disclosure. A system according to examples of the present disclosure includes a main module 20, and a battery module 40 configured to be removably coupled to the main module to form the modular canal hearing device 1, interchangeably referred to herein as a canal hearing device assembly, for example as shown in FIG. 1. The system further includes a disengagement tool 60, which includes one or more cavities 70, also referred to herein as receptacle cavity 70, configured to receive a lateral end of the modular canal hearing device 1 and disengage the battery module 40 therefrom.

Figure 2:
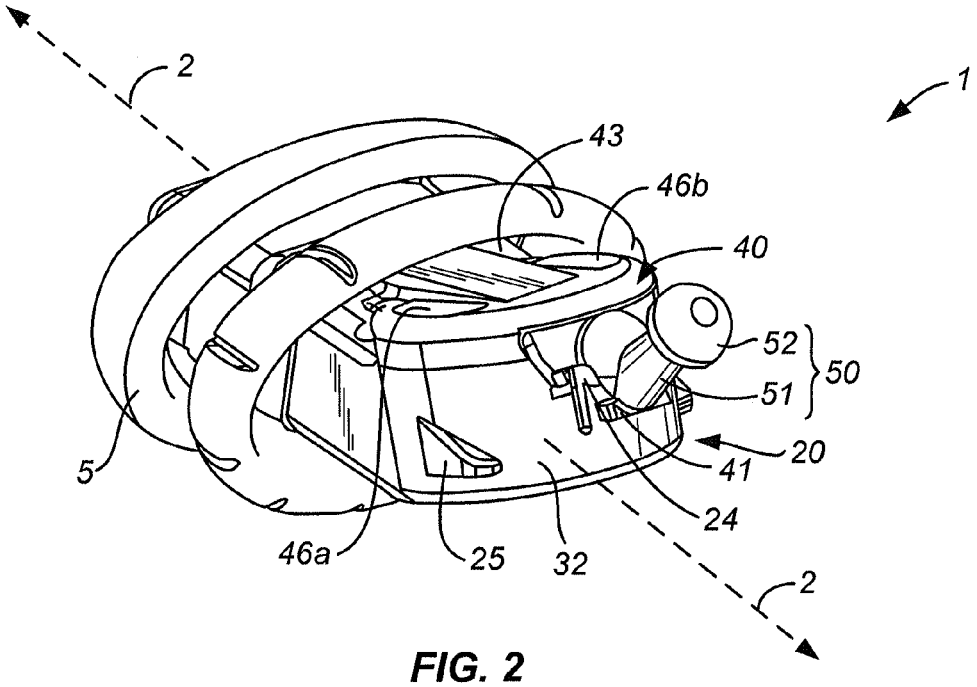
FIG. 2 is an alternate isometric view of the modular canal hearing device of FIG. 1, depicting a battery module of the canal hearing device engaged with a main module of the canal hearing device, and further depicting a seal assembly attached thereto.

The main module 20 is implemented for positioning primarily inside the ear canal and includes a microphone, a receiver, and circuitry known in the art of hearing aid design. The battery module 40 includes a battery cell 42 and is configured for a cooperating fit within the lateral end 32 of the main module 20. The main module 20 and battery module 40 when coupled together form the modular canal hearing device assembly 1, which includes a lateral end 32, as shown in FIG. 2 for example. The disengagement tool 60 may be used to switch the modular canal hearing device assembly 1 electromechanically to an OFF position, or to remove the battery module 40 entirely. The disengagement tool 60 may be configured to automatically disengage the battery module 40 upon insertion of the lateral end 32 of the modular canal hearing device assembly 1, generally along its longitudinal axis 2, into the receptacle cavity 70 of the disengagement tool 60. In the preferred embodiments, the receptacle cavity 70 incorporates a disengagement mechanism as will be described below.

Figure 6:
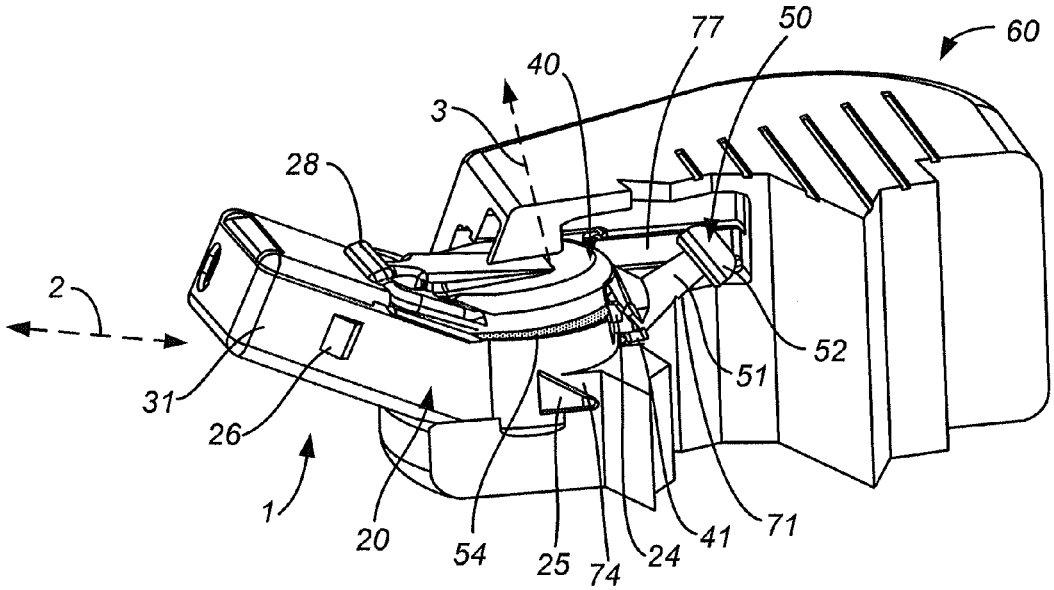
FIG. 6 is a cut-away view of an embodiment of the disengagement tool showing shallow disengagement of the battery module representing the power OFF condition when the modular canal hearing device assembly is fully inserted into the receptacle cavity.
Figure 7:
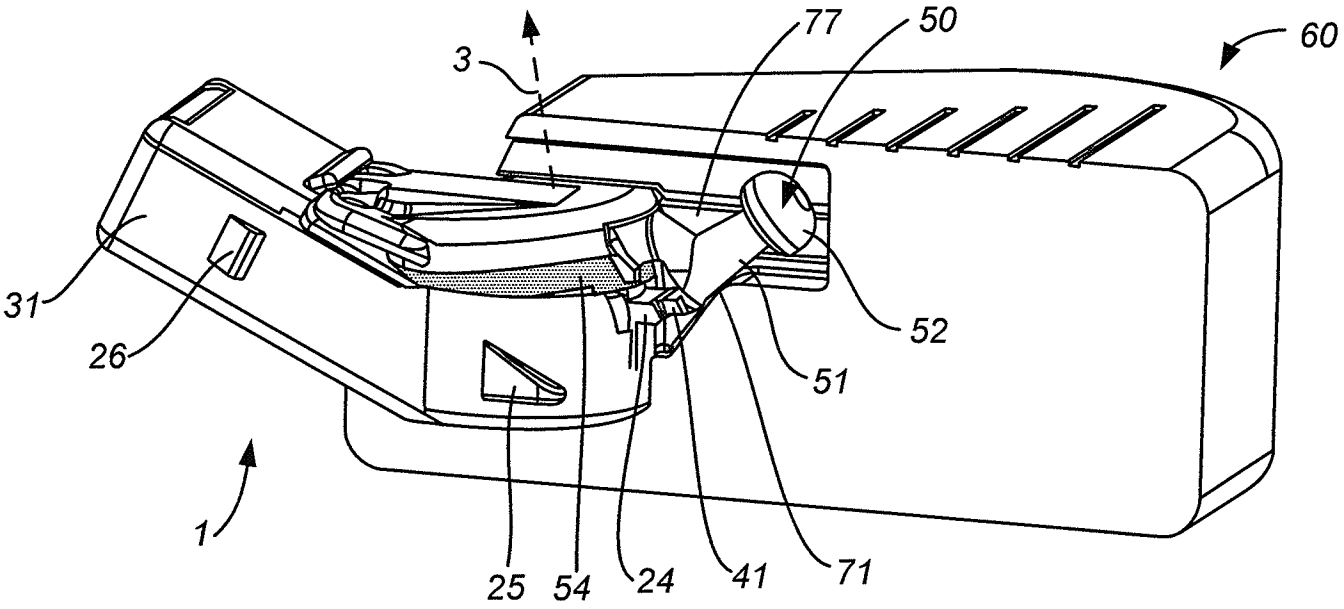
FIG. 7 is a cut-away view of an alternate embodiment of the disengagement tool depicting a removal cavity configured for substantial disengagement of the battery module for its removal from the main module.
Figure 8:
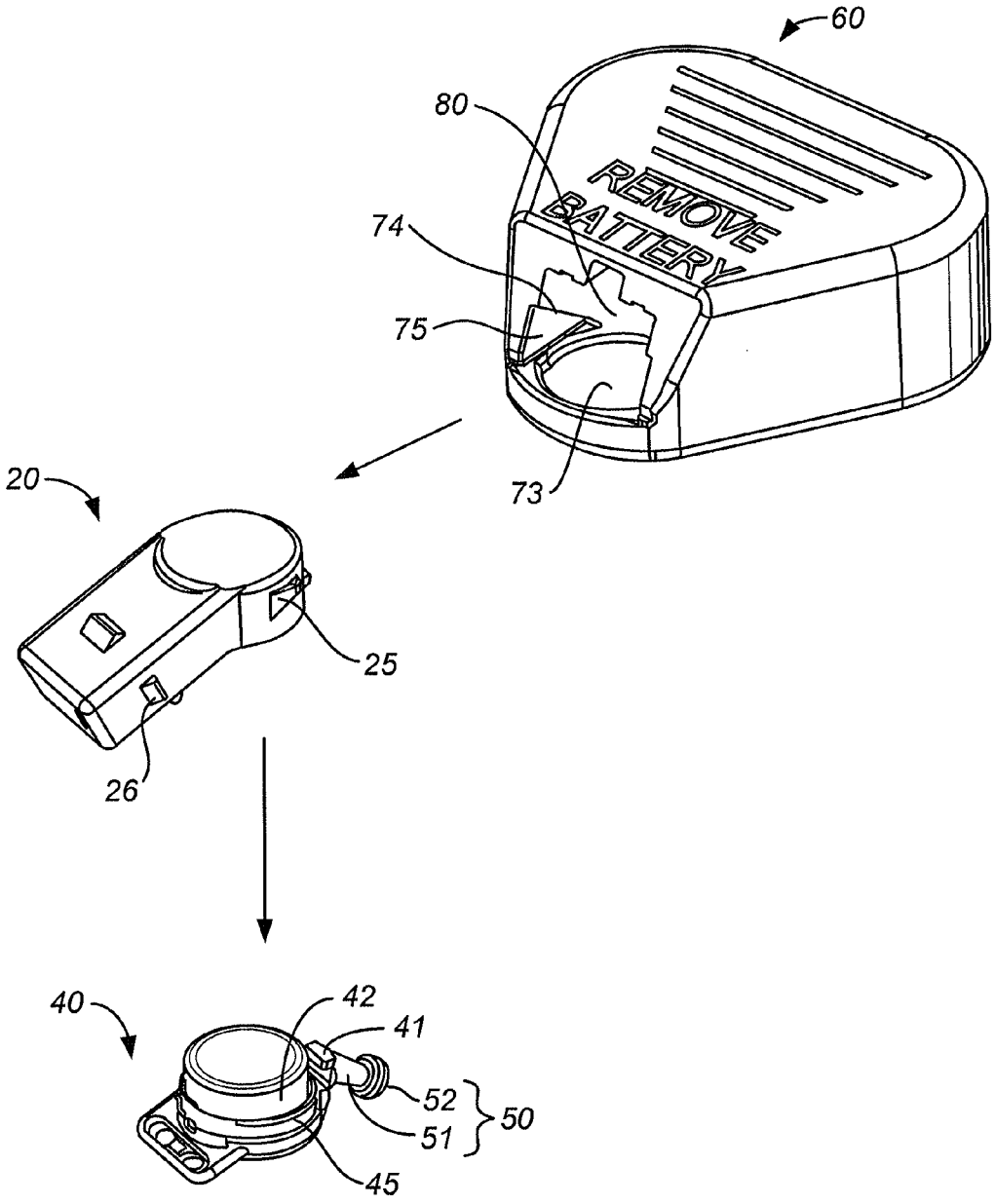
FIG. 8 shows an example of separation of the battery module from the main module after insertion of the modular canal hearing device assembly into the disengagement tool of FIG. 7.

In the embodiments depicted in FIGS. 1-10, the main module 20 includes a housing 35, which may be generally rectangular in cross section, and which has a medial end 31 (towards the ear drum) and a lateral end 32 (away from the eardrum) for manual access and manipulation. Other form factors may of course be used. The main module 20 may comprise transducers (not shown) and circuitry including a digital signal processor (not shown), which may be enclosed at least in part within the housing 35. The main module 20 includes a receiving cavity 21 (see e.g., FIG. 3) configured to accommodate at least a portion of the battery module 40 therein. For example, the cavity 21 may have a shape corresponding generally to the shape of the portion of the battery module 40, and particularly the battery cell 42, to be received therein. In a particular example, the cavity 21 may be generally circular and may be configured to accommodate a battery module 40, which includes a standard sized/shaped battery, for example a button cell type as shown in FIG. 8. In some examples, the main module 20 includes electrical contacts 36 and 37 (see e.g., FIG. 3) for electrically connecting the battery cell 42 of the battery module 40 to electrical components (not shown) within the main module 20. For example, the first electrical contact 37, which may be circumferentially disposed, may be for the positive terminal of the battery cell 42 and a second electrical contact 36, which may be disposed at the bottom of the cavity 21, may be for the negative terminal of the battery cell 42. In some examples, the main module 20 may also include data contacts 27 for transmitting data signals to and/or from the main module 20, for example for programming and/or otherwise communication with the circuitry in the main module 20 via external devices (not shown). The main module 20 includes one or more sound ports, which may be implemented as a sound aperture 29 and which may be located so as to be proximate to a sound port 47 of the battery module 40 (described further below) when the main module 20 and battery module 40 are in engagement. When the battery module 40 and main module 20 are coupled together, the sound aperture 29 and sound port 47 may be arranged relative to each other so as to define an acoustic path for incoming sound to reach the microphone.

Figure 3:
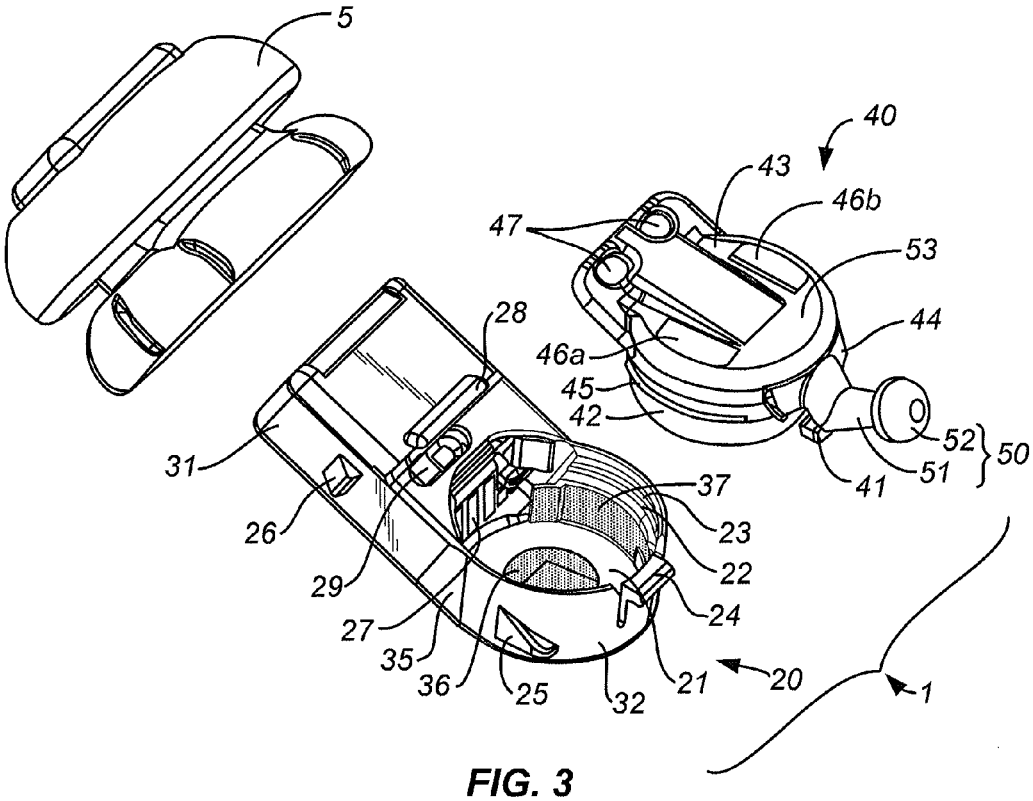
FIG. 3 is an isometric view of the modular canal hearing device of FIG. 2 depicting the battery module, the seal assembly, and the main module completely disengaged or separated from one another.
Figure 4:
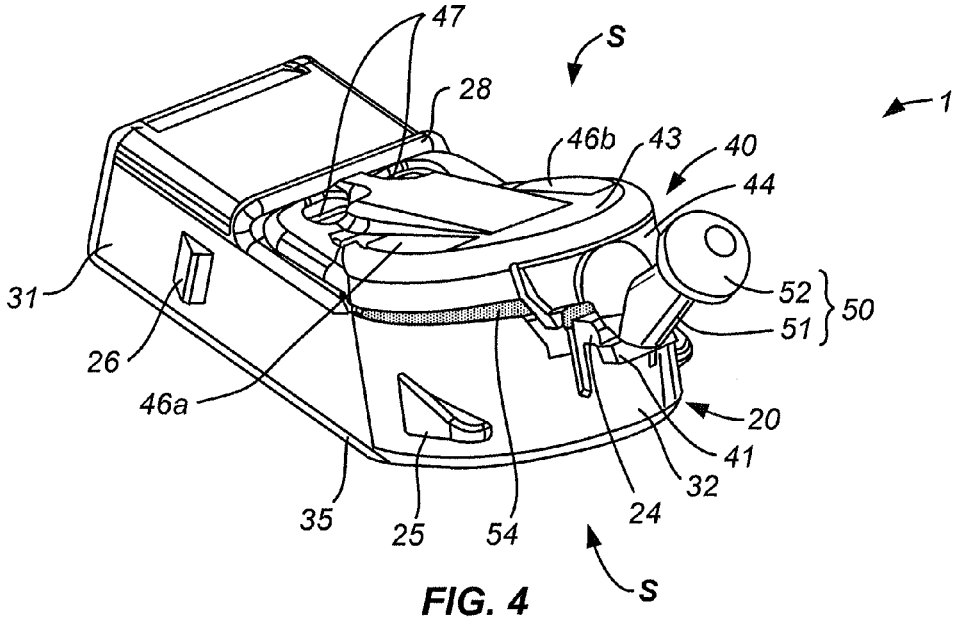
FIG. 4 is an isometric view of a modular canal hearing device assembly depicting a battery module partially disengaged from a main module, representing the power OFF condition.

The main module 20 includes a main module housing 35 which includes certain features configured for engagement of the main module 20 with the battery module 40, the disengagement tool 60, and/or a seal tip assembly 5. These features may be implemented according to a variety of form factors as may be suitable for the particular application. For example, the housing 35 may include a first feature (e.g. a stop tab 24) disposed on the lateral end 32 of the main module 40 and configured to engage with a second feature (e.g. latch tab 41) positioned on a lateral end 44 of the battery module 40. The stop tab 24 and the latch tab 41 may be configured to maintain the battery module 40 in partial engagement with the main module 20 when the two modules (20 and 40) are partially disengaged as shown in FIG. 4. In the particular example depicted in FIGS. 2-4, the stop tab 24 is implemented as a generally elongated element attached to or integrally formed with the handle 50, which stop tab is shaped and positioned on the handle for a cooperating engagement with the latch tab 41, implemented here as a generally L-shaped member at the lateral end of the main module. Other form factors may be used, for example the stop tab 24 may be attached to other portions of the battery module, other than the handle 50. Additionally, the main module 20 may include a feature 28 (also referred to herein as a battery module holding ledge) configured to securely hold the battery module 40 in a pivoting manner within the main module 20. In the particular example depicted in FIGS. 3, 4, 6, 9 and 10, the battery module holding ledge 28 is positioned generally on the center portion of the main module 20. Other form factors may be used.

The main module 20 may also include circumferential features configured to engage corresponding circumferential features of the battery module 40 to maintain the battery module in partial engagement with the main module 20, when the two modules (20 and 40) are partially disengaged. For example, the main module 20 may include holding grooves (e.g. lower holding groove 22 and upper holding groove 23) incorporated within the receiving cavity 21 as shown in FIG. 3. The holding grooves 20, 23 are configured to secure the battery module 40 into one of two holding positions, with the lower holding groove 22 securing the battery module in a power ON position and the upper holding groove 23 securing the battery module in a power OFF position. The holding grooves 22 and 23 are generally shaped in a complimentary manner to a circumferential holding detent 45 of the battery module 40. As will be appreciated, in some examples, the circumferential grooves 22, 23 and corresponding detent 45 may be continuous (e.g. extend around the full perimeters of the main module 20 and/or battery module 40), or in some examples they may extend only partially around the respective perimeters of the modules. The lower holding groove 22 is configured to maintain the battery module 40 in the power ON position, whereby the battery cell 42 is electrically engaged with electrical contact 36. On the other hand, the upper holding groove 23 is configured to maintain the battery module 40 in the power OFF position, whereby the battery cell 42 is electrically disengaged from the electrical contact 36.

When the battery module 40 is provided in the OFF position, a gap 54 may be formed (see FIG. 4) separating the battery module 40 and the main module 20 at the lateral end of the hearing device assembly 1. In some examples, the gap 54 may be relatively narrow (e.g. a fraction of the height of the battery module 40). As described above, the stop tab 24 may be arranged so at to control the amount of separation (e.g. gap 54) between the battery module 40 and the main module 20 and limit or prevent any further separation wider than the gap 54. The modular canal hearing device assembly 1 may be switched from the power ON condition (corresponding to the power ON position of the battery module 40) to the power OFF condition (corresponding to the power OFF position of the battery module) by manual action, or by an automatic disengagement mechanism as described herein. It will be understood that other arrangements for engaging and disengaging the modules may be used. For example, the arrangement of the engagement features may be reversed. In one such example, one or more circumferential holding detents may be placed within the receiving cavity 21 of the main module 20 while one or more circumferential holding grooves may be provided on the housing of battery module 40. The holding detents and holding grooves may function in a similar manner as described above to secure the battery module in either a power ON or a power OFF position.

Figure 5:
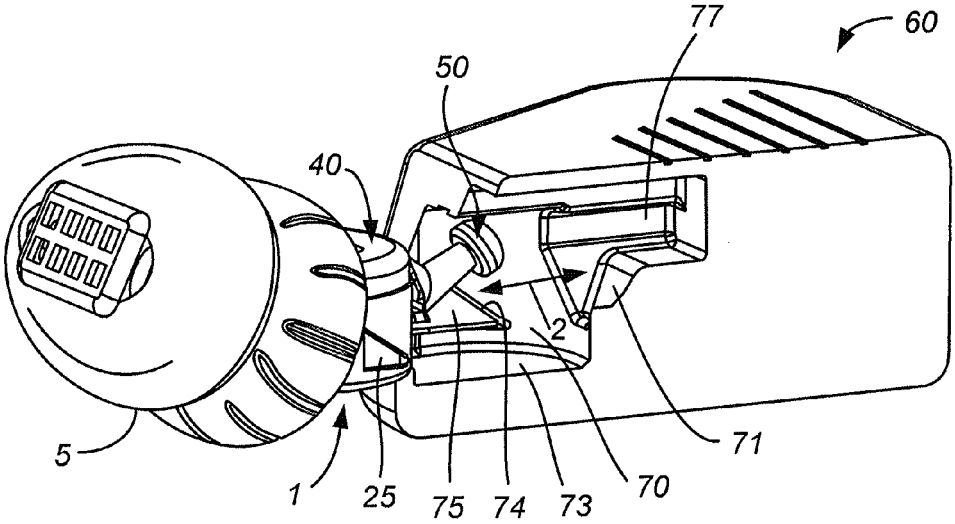
FIG. 5 is a cut-away view of a disengagement tool of FIG. 1 depicting the modular canal hearing device assembly being inserted into the receptacle cavity of the disengagement tool.

In one example, as shown in FIGS. 5 & 6, holding tabs 25 (one holding tab may be provided on each side of the lateral end 32) are configured to engage with holding ledges 74 located within the receptacle cavity 70 of the disengagement tool 60. In this embodiment, the receptacle cavity 70 is configured to allow the holding tabs 25 to advance through the holding recesses 75 (FIG. 5) located on each side of the receptacle cavity 70 until the holding tabs 25 are prevented from further advancement therein by the holding ledges 74. In this manner, the cavity 70 features therein may be configured to maintain the main module 20 into the receptacle cavity 70 and/or in a predetermined position or orientation while the battery module 40 is being automatically disengaged by the insertion of the modular canal hearing device assembly 1 into the disengagement tool 60. Features (e.g. holding recesses 75 and/or ledges 74) in the cavity 70 may be configured to partially immobilize at least a portion of the canal hearing device assembly 1, while the battery module is being disengaged as described herein.

The main module 20 may be connected at its medial end 31 to a seal tip assembly 5, preferably made of a flexible polymeric material such as Silicone, and configured as a replaceable or disposable component. The seal tip assembly 5 may be disposed about the medial end 31 of the main module 20. The seal tip assembly 5 attaches to the main module 20 by engaging with a holding tab 26, positioned generally on the medial end 31 of the main module 20. One or more holding tabs 26 for securing the seal tip assembly 5 to the main module 20 may be included, and in some examples holding tabs 26 may be arranged virtually anywhere around the perimeter at the medial end 31. Holding tabs 26 may be provided on sides, top and/or bottom surfaces of the housing 35 at the medial end 31.

The battery module 40, which incorporates a battery cell 42 therein, is configured for mating with the lateral end 32 of the main module 20 to form the lateral end of the modular canal hearing device assembly 1, also referred to as 32. The battery module 40 includes a housing 43 that is sized and shaped in a corresponding shape to the shape of the battery cell 42 incorporated therein, generally substantially cylindrical. In a preferred embodiment, the battery cell 42 is non-removably integrated within the battery module 40. In other embodiments, the battery cell 42 may be removable from the battery module housing 43.

In some embodiments, the battery module 40 includes a sound port 47 to receive incoming sound and deliver it to the microphone within the main module 20. A waterproof debris barrier (not shown) may be placed either over, within, or underneath the sound port 47 to prevent water or debris from entering the main module and reaching electronic components, and particularly the microphone in the main module 20, thus allowing the device to be worn safely during water exposure such as when swimming or showering. The debris barrier is preferably made of a porous cloth, film or membrane that is acoustically transparent (e.g., permits sound to be transmitted across). The battery module may be disposable according to the teachings in U.S. patent Ser. Nos. 12/878,926 or 13/424,242.

In some examples, the battery module 40 may include a handle 50 to facilitate handling of the battery module or the hearing device 1 by the user. The handle 50 may include a shaft 51 and a knob 52. As will be appreciated, such a configuration allows for manipulation of the battery module 40 during insertion of the modular canal hearing device assembly 1 into the ear canal. The handle also facilitates disengagement of the battery module 40 according to the examples herein when the modular canal hearing device assembly 1 is inserted into receptacle cavity 70 of the disengagement tool 60.

In one embodiment, the battery module 40 may include a rechargeable battery cell 42 as shown in FIGS. 2-4. In this embodiment, the battery module 40 may comprise electrical contacts (46*a* and 46*b*) on the external surface of the battery module housing 43. The electrical contacts (46*a* and 46*b*) may be configured for receiving electrical charge from an external power source, for example a charging station (not shown).

Figure 12:
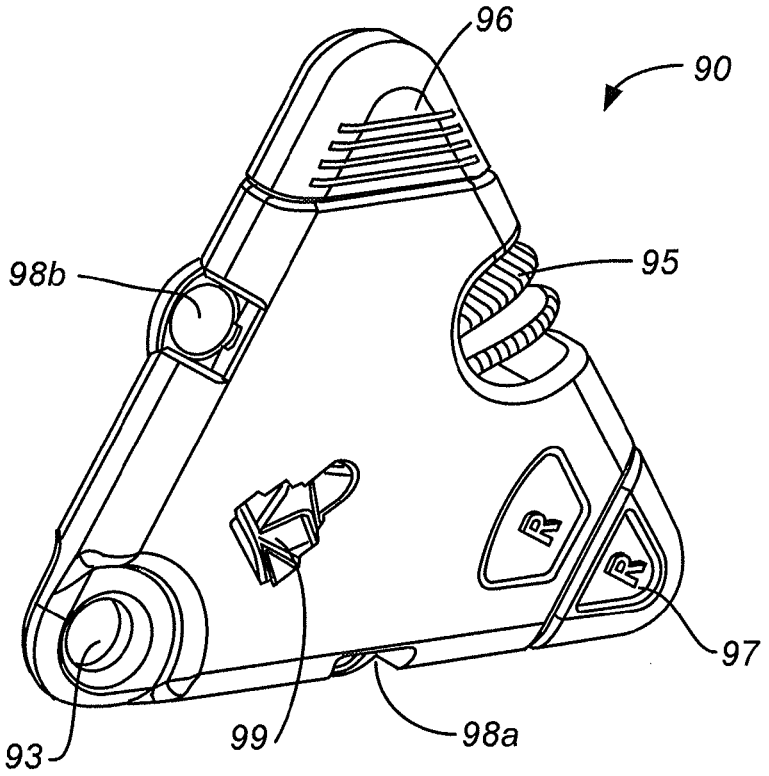
FIG. 12 is an isometric view of a multifunction tool incorporating three disengagement cavities, of which two are configured for partial disengagement, and one configured for battery removal, in addition to a device insertion tool, a removal tool, and a remote control.
Figure 13:
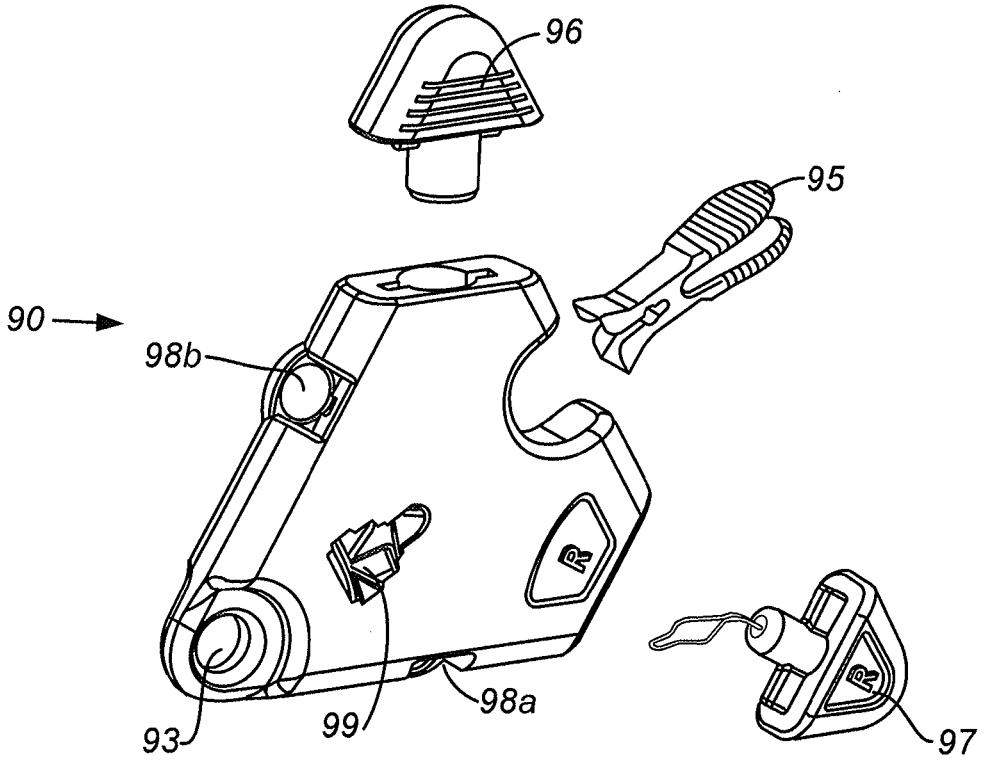
FIG. 13 is an isometric view of the multifunction tool of FIG. 12, where the insertion tool, removal tool, and remote control are shown withdrawn from the multifunction tool housing.

Examples of tools for disengaging and/or removing a battery module 40 from the main module 20 will be described with further reference to FIGS. 5-13. A disengagement tool 60 according to the present disclosure may include one or more disengagement cavities 70 (also referred to herein as receptacle cavities). In some examples, the disengagement tool 60 may include a single receptacle cavity 70, (e.g., as shown in FIGS. 1, and 5-8). The tool 60 may include a removal cavity 80 instead of or in addition to the disengagement cavity 70. In the context of the present disclosure a disengagement cavity 70 may be configured to partially disengage the battery from the main module (e.g. to provide the battery from an ON position to the OFF position). A removal cavity 80 may be configured to substantially disengage the battery module 40 so as to facilitate removal of the battery module 40 therefrom. FIGS. 11-13 show examples of disengagement tools 60 with a plurality of cavities, including a disengagement cavity 70 and a removal cavity 80. In the examples of FIGS. 12 and 13, the disengagement tool 60 includes a plurality of disengagement cavities (e.g. two power OFF cavities 98*a* and 98*b*), so that a pair of canal hearing devices (e.g. a left canal hearing device assembly 1 and a right canal hearing device assembly 1) may be inserted in the cavities 98*a* and 98*b* for turning them OFF and for storing them in the OFF condition, for example when not in use.

In the preferred embodiments, the receptacle cavity 70, now referring to FIGS. 5-7, includes a channel 77 for receiving the handle 50 at the lateral end of each modular canal hearing device assembly 1. The receptacle cavity 70 may be configured to partially disengage the battery module 40 from the main module 20 to switch the modular canal hearing device assembly 1 to the OFF condition as in FIG. 6. In some examples, the cavity may be a removal cavity 80 configured to substantially disengage the battery module 40 from the main module 20 to facilitate removal of the battery module 40 as in FIG. 7.

The receptacle cavity 70 is shaped to accommodate therein the lateral end 32 of the modular canal hearing device assembly 1. The lateral end 32 of the modular canal hearing device assembly 1 is inserted into the receptacle cavity 70, generally along the longitudinal axis 2 of the modular canal hearing device assembly 1, while the medial end 31 of the modular canal hearing device assembly 1 protrudes from the disengagement tool 60. The receptacle cavity 70 includes features configured to actuate the handle 50 for disengaging the battery module 40 and placing the modular canal hearing device assembly 1 in the power OFF condition. The receptacle cavity 70 may include certain structures configured to operatively engage the lateral end 32 of the canal hearing device to achieve a disengagement of the battery as will be further described below.

The receptacle cavity 70 is shaped generally to lead-in the lateral end 33 of the modular canal hearing device assembly 1 towards the cavity floor 73 and holding recesses 75 located on the each side (FIGS. 1, 5, 6 & 7) therein. Upon placement of the lateral end 32 into the receptacle cavity 70, the holding ledge 74 secures the holding tab 25 thereby maintaining the main module 20 in a particular position within the receptacle cavity 70, while the battery module 40 is being displaced by the disengagement ledge 71 (FIGS. 6-7). This disengagement occurs automatically as generally an axial force along the longitudinal axis 2 is applied to the hearing device assembly 1 being axially into the receptacle cavity 70, causing the battery module 40 to partially disengage, generally in the perpendicular direction 3 with respect to the longitudinal axis 2 of the main module 20. Disengagement of the battery module 40 causes a separation or a gap 54 between at least a portion of the battery module and at least a portion of the main module, whereby the battery cell 42 becomes electrically disconnected from electrical contact 36 of the main module 20. In this regard, disengagement of the battery module 40 results in the main module 20 and the battery module 40 being electromechanically separated. This electromechanical separation represents the power OFF position of the battery module (e.g. the power OFF condition for the hearing device assembly 1). In the above example, the battery module 40 is displaced by utilizing the handle 50 as an actuator, whereby the disengaging ledge 71 within the channel 77 of the receptacle cavity 70 is configured to push the handle 50 and the battery module 40 attached thereto away from the main module 20, generally in the perpendicular direction 3, resulting in partial disengagement and the power OFF position while the canal hearing device assembly 1 remains at least partially restrained from movement in the direction 3 by virtue of holding features of the receptacle cavity 70 as described herein. The channel 77 is configured to accommodate the handle 50 while the disengagement ledge 71 is configured for automatic disengagement of the battery module 40. Partial disengagement of the battery module 40, as in FIG. 6, is maintained by the complimentary holding features within the main module 20 and the battery module 40, for example by circumferential holding detent 45 within the battery module 40 and circumferential holding groove 23 within the main module 20.

In other embodiments as in FIGS. 7-11, the displacement of the battery module 40 results in substantial separation of the battery module 40 with respect to the main module 20, causing not only electrical disengagement between the battery module 40 and the main module 20, but also separation of engagement features within the modules for the complete removal of the battery module 40. In these embodiments, the cavity is configured as a removal cavity 80 allowing for battery module removal, such as for battery module replacement, battery cell replacement, or for programming of the main module by a programming interface (not shown). In the examples shown herein, the extent of disengagement for the battery module 40, whether for partial disengagement with narrow gap (e.g., gap 54 in FIG. 6) or substantial disengagement with relatively wider gap (e.g. gap 54 in FIG. 7), is generally determined by the profile of the disengagement ledge 71 with respect to the handle 50, or more specifically its shaft 51. For example, the disengagement ledge 71 may be extended higher to displace the battery module 40 further. As will be appreciated, the shaft 51 of the handle 50 may be arranged at a given angle relative to the base of the later end 32. An angle of the ledge 71 may be varied (e.g. made shallower or steeper) to control an amount of force/actuation to be observed by the handle 50 when the lateral end 32 is inserted in the cavity.

In one example, as depicted in FIG. 8, the modules (e.g. battery module 40 and main module 20) are manually withdrawn from the receptacle cavity 70 of the disengagement tool 60 after partial disengagement with the battery module 40 remaining partially attached to the main module 20. The battery module 40 can subsequently be removed from the main module 20 outside the receptacle cavity 70 by the user by as shown.

Figure 9:
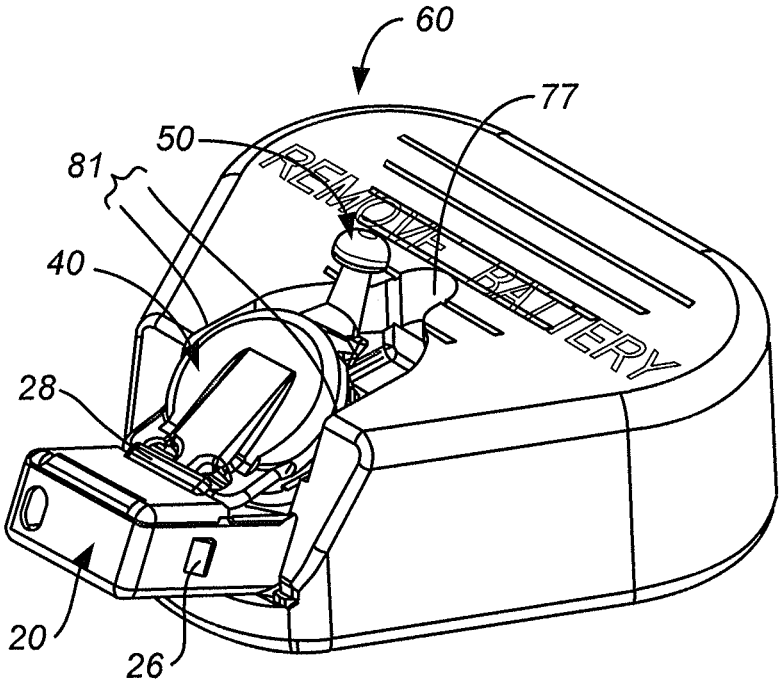
FIG. 9 is an isometric view of an alternate battery removal tool configured to disengage and hold the battery module within the removal cavity.
Figure 10:
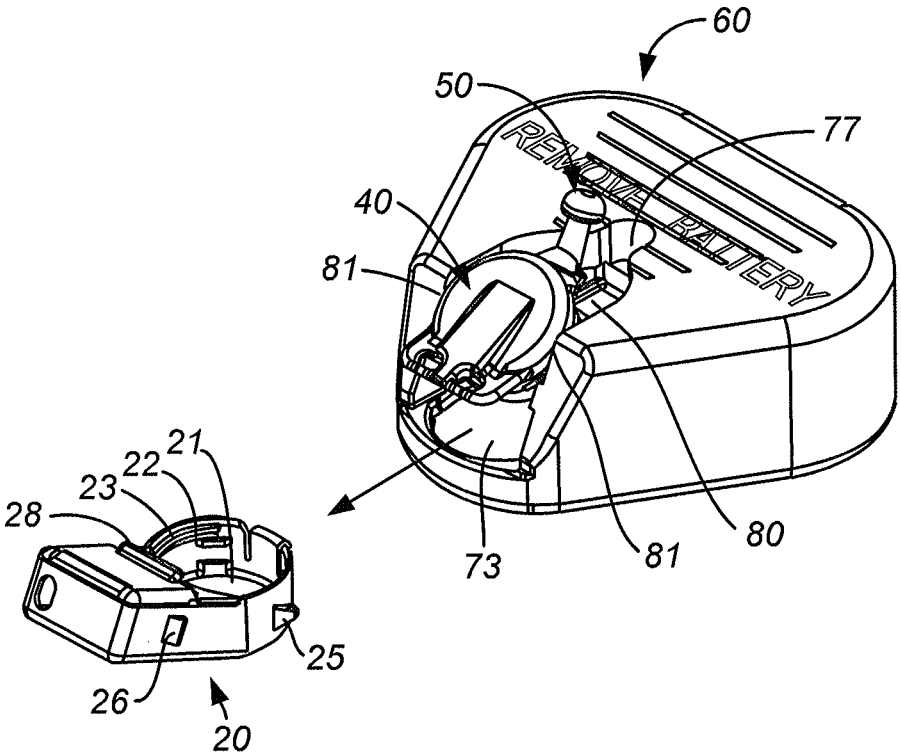
FIG. 10 is a view of a removal tool of FIG. 9 showing the automatic holding of the battery module when the main module is withdrawn from the removal cavity.
Figure 11:
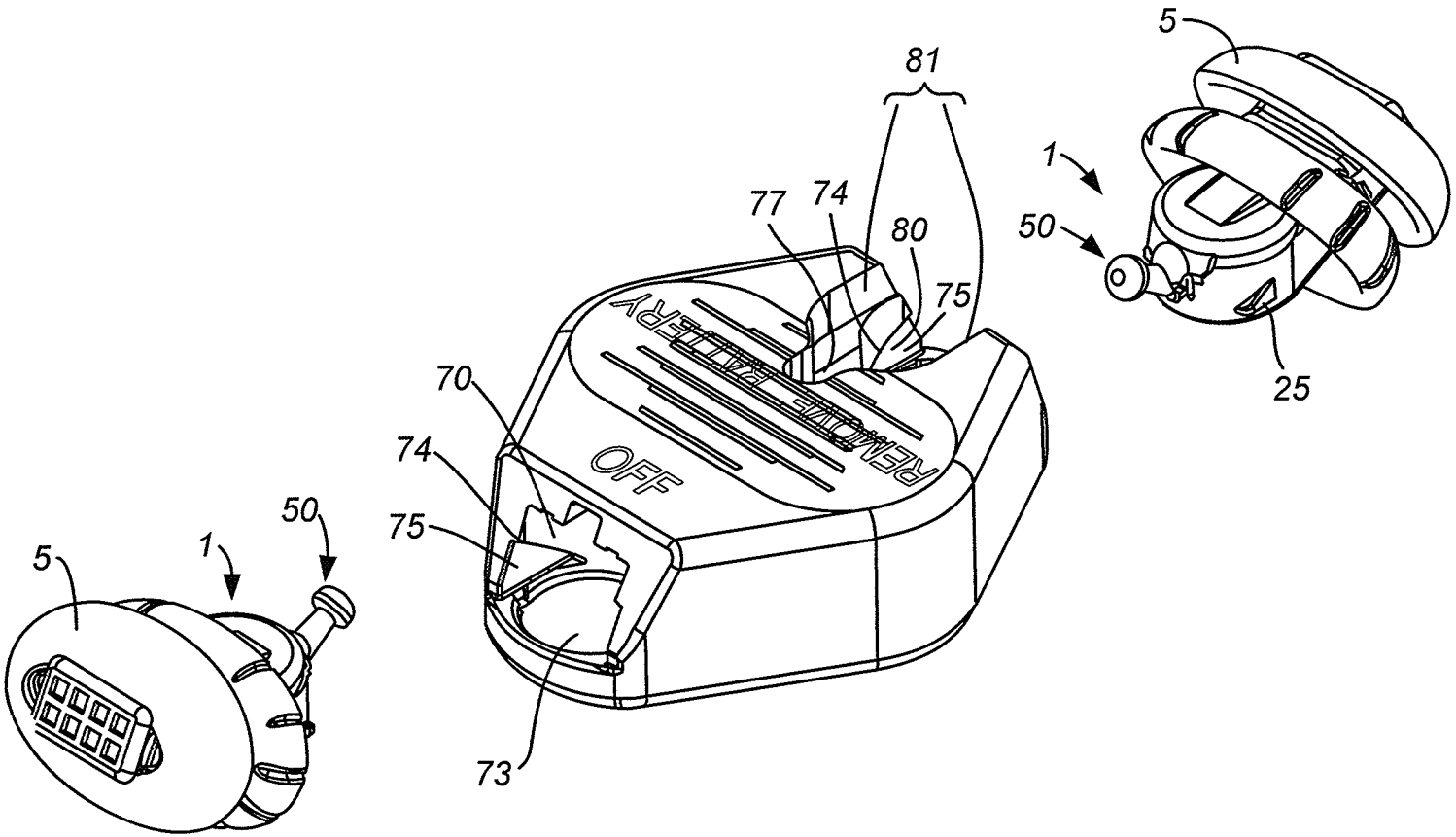
FIG. 11 is an isometric view of a dual cavity embodiment of a disengagement tool, where a first cavity is configured to partially disengage a battery module for the power OFF position, and a second cavity is configured to a removal cavity to substantially disengage the battery module for its removal from the main module.

In other examples, as shown in FIGS. 9-11, the battery module 40 may be retained within the disengagement tool 60 when the main module 20 is withdrawn from the receptacle cavity, configured as removal cavity 80. In these examples of the disengagement tool 60, the removal cavity 80 incorporates a pair of holding ledges 81 for retaining the battery module 40, by friction for example, when the modular hearing device assembly 1 is inserted therein. The holding ledges 81 may use other mechanical or magnetic means for retaining the battery module 40 in place while the main module 20 is being withdrawn from the cavity 80.

FIG. 11 shows a dual cavity disengagement tool 60, with a receptacle cavity 70 for power OFF disengagement, and a removal cavity 80 on the other side for removal of the battery module 40 as discussed above, providing the user with a dual purpose tool. In the alternate embodiment of the canal hearing device system (not shown) described above, the handle is incorporated in the main module 20. In this example, the receptacle cavity 70 or removal cavity 80 includes holding tabs (not shown) that engage holding recesses (not shown) incorporated within the battery module 40 to secure the battery module 40 while the main module 20 is being displaced. It will be understood that the certain features for holding and displacing the modules of the modular canal hearing device assembly 1 may be configured in a variety of arrangements, not limited by the examples disclosed herein, and are generally interchangeable and thus may be placed on either the lateral end 32 of the modular canal hearing device assembly 1 or within the disengagement cavity.

The modular canal hearing device assembly 1 may be switched from the OFF to ON, by providing the battery module 40 from the OFF position to the ON position by a snap action, whereby the circumferential holding detent 45 of the battery module 40 is displaced from the upper groove 23 to the lower groove 22 within the main module 20. This may be accomplished by applying a squeezing force (S in FIG. 4) by the user's fingers to snap the battery module 40 into the ON position. As such, the complimentary holding features of the battery module housing 43 and main module housing 35 may advantageously enable an effective switching mechanism for a device with miniaturized physical dimensions (as may be typical for hearing aid devices) and without utilizing additional components. In some embodiments of the present invention, the profile of the protrusion of the holding detent 45 is roughly equal to the depth of circumferential grooves 22 and 23, and may be approximately 0.12 mm, and preferably not to exceed 0.3 mm.

In one embodiment, an integrated multifunction tool 90 (FIGS. 10 and 11) is provided for the user to power OFF and remove the battery module 40 of a modular canal hearing device assembly 1, while incorporating other tools for use with the modular canal hearing device assembly 1. The other tools may include a remote control 96 for remotely controlling the modular canal hearing device assembly 1, an ear canal insertion tool 95 for the insertion of the modular canal hearing device assembly 1 into the ear canal 10, and an ear canal removal tool 97 for removing the modular canal hearing device assembly 1 from the ear canal 10. The multifunction tool 90 may facilitate the use of the modular canal hearing device assembly 1 by incorporating a plurality of accessories in a single portable housing. In the example shown in FIGS. 12 and 13, a first receptacle cavity **98*a* may be configured to receive a first modular canal hearing device assembly 1, for example a left modular canal hearing device for a left ear, and a second receptacle cavity 98*b* may be configured to receive a second modular canal hearing device assembly 1, for example a right modular canal hearing device for a right ear. A removal cavity 99 disengages the battery module 40 for its removal. The multifunction tool assembly 90 may also include a keychain hole 93**.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A disengagement tool for a canal hearing device including a main module and a battery module incorporating a battery cell therein, the disengagement tool comprising:

a cavity for receiving a lateral end of the canal hearing device, wherein the cavity is configured to cause the battery module to automatically disengage, at least in part, from the main module upon axial insertion of a lateral end of the canal hearing device into the receptacle cavity.

2. The disengagement tool of claim 1, wherein the cavity comprises a channel for receiving a handle disposed at the lateral end of the canal hearing device.

3. The disengagement tool of claim 2, wherein the channel is configured to accommodate a handle comprising a shaft and a knob attached to the shaft.

4. The disengagement tool of claim 2, wherein the channel comprises a ledge configured to actuate the handle during insertion of the canal hearing device into the receptacle cavity.

5. The disengagement tool of claim 1, wherein the cavity includes features configured to cause a separation of the battery module from the main module sufficient to provide the canal hearing device in a power OFF condition.

6. The disengagement tool of claim 1, wherein the cavity comprises a ledge configured to actuate the lateral end of the canal hearing device to disengage the battery module from the main module.

7. The disengagement tool of claim 1, wherein the cavity comprises holding features configured to maintain a portion of the canal hearing device in a predetermined position when inserted therein.

8. The disengagement tool of claim 1, wherein the cavity is configured to cause the battery module to separate from the main module in a generally perpendicular direction with respect to a longitudinal axis of the canal hearing device.

9. A canal hearing device system comprising:

a canal hearing device comprising a main module and a battery module incorporating a battery cell within; and a disengagement tool including a receptacle cavity configured to receive a lateral end of the canal hearing device and automatically disengage, at least in part, the battery module from the main module upon axial insertion of the lateral end into the receptacle cavity.

10. The canal hearing device system of claim 9, wherein the canal hearing device comprises a handle at the lateral end.

11. The canal hearing device system of claim 10, wherein the handle comprises a shaft and a knob attached at one end of the shaft.

12. The canal hearing device system of claim 10, wherein the cavity comprises a channel for accommodating the handle.

13. The canal hearing device system of claim 10, wherein the receptacle cavity comprises a ledge for actuating the handle to disengage the battery module.

14. The canal hearing device system of claim 10, wherein the handle is attached to the battery module.

15. The canal hearing device system of claim 9, wherein the receptacle cavity comprises holding features for at least partially immobilizing the lateral end of the canal hearing device when inserted therein.

16. The canal hearing device system of claim 9, wherein the receptacle cavity is configured to disengage the battery module in a generally perpendicular direction with respect to a longitudinal axis of the canal hearing device.

17. A multifunction tool for use with a canal hearing device, the multifunction tool comprising:

a body including:

a cavity configured to receive a canal hearing device partially therein, the canal hearing device including a main module and a battery module, the cavity further configured to automatically disengage, at least in part, the battery module from the main module upon axial insertion of the canal hearing device partially into the cavity; and at least one of a remote control for controlling the canal hearing device remotely, an insertion tool configured to grasp a lateral end of the canal hearing device for inserting the canal hearing device into the ear canal, and a removal tool configured to engage with the lateral end of the canal hearing device for removing the canal hearing device from the ear canal, wherein the at least one of the remote control, the insertion tool, or the removal tool is removably coupled to the body.

18. The multifunction tool of claim 17, wherein the cavity comprises a channel configured to accommodate a handle located at the lateral end of the canal hearing device, the cavity further comprising a ledge configured to actuate the battery module away from the main module.

19. The multifunction tool of claim 17, wherein the cavity comprises features for immobilizing, at least in part, the lateral end of the canal hearing device when inserted therein.

20. A method for turning off a canal hearing device which includes a main module and a battery module incorporating a battery cell therein, the method comprising:

inserting the lateral end of the canal hearing device into a receptacle cavity of a disengagement tool, the receptacle cavity configured to receive a lateral end of the canal hearing device, the receptacle cavity further configured to automatically disengage the battery module from the main module upon axial insertion of the lateral end of the canal hearing device into the receptacle cavity;

applying an axial force to the canal hearing device; and actuating the battery module using features incorporated within the receptacle cavity to partially disengage the battery module from the main module thereby providing the canal hearing device in a power OFF condition.

21. The method of claim 20, wherein actuating the battery module comprises actuating a handle located at a lateral end of the canal hearing device using a ledge in the receptacle cavity.

22. The method of claim 20, wherein applying the axial force comprises applying sufficient force to cause a displacement of the battery module from a first position to a second position.

23. The method of claim 20, wherein the battery module is maintained in the first position and in the second position by holding features, and wherein the holding features comprise a circumferential groove and a detent.

24. The method of claim 20, further comprising withdrawing the canal hearing device from the receptacle cavity, wherein the battery module remains partially disengaged from the main module after said withdrawal.

25. A method for removing a battery module of a modular canal hearing device from a main module of the modular canal hearing device, the method comprising:

inserting a lateral end of the modular canal hearing device into a removal cavity of a disengagement tool comprising a removal cavity for receiving a lateral end of the modular canal hearing device, wherein the removal cavity includes disengagement features for automatically disengaging the battery module from the main module upon axial insertion of the lateral end of the modular canal hearing device into the receptacle cavity;

applying an axial force to engage the lateral end with the disengagement features to cause the battery module to automatically disengage from the main module; and withdrawing the main module from the removal cavity while the battery module remains attached to the disengagement tool.

26. The method of claim 25, further comprising holding the battery module using holding features incorporated within the removal cavity.

27. The method of claim 25, further comprising removing the battery module from the removal cavity.

28. A canal hearing device comprising:

a main module incorporating a microphone, a receiver, and circuitry, the main module adapted for positioning in the ear; and a battery module incorporating a battery cell therein, the battery module configured to be coupled to the main module, wherein the battery module is configured to automatically disengage, at least in part, with respect to the main module upon axial insertion of a lateral end of the canal hearing device into a receptacle cavity, and wherein the canal hearing device further comprising a detent, a first circumferential groove for holding the detent in a first position representing an ON condition, and a second circumferential groove for holding the detent in a second position representing an OFF condition.

29. The modular canal hearing device of claim 28, wherein the lateral end of the canal hearing device comprises a latch tab and stop tab configured to maintain the battery module at least partially mechanically engaged to the main module.

30. The canal hearing device of claim 28, wherein said battery module further comprises a sound port for receiving incoming sound and delivering the incoming sound to the main module.

* * * * *